United States Patent [19]

Rathmell

[11] 3,988,842

[45] Nov. 2, 1976

[54] MOLDED HINGED AND CORRUGATED SKI BOOT

[76] Inventor: Richard K. Rathmell, 12 Pine Tree Road, Ramsey, N.J. 07446

[22] Filed: June 19, 1975

[21] Appl. No.: 588,204

[52] U.S. Cl. ..... 36/121

[51] Int. Cl.[2] ..... A43B 5/04

[58] Field of Search ..... 36/2.5 R, 2.5 AL, 50, 36/120, 121

[56] References Cited

UNITED STATES PATENTS

| | | | |
|---|---|---|---|
| 3,408,752 | 11/1968 | Lollmann | 36/2.5 AL |
| 3,522,668 | 8/1970 | Fesl | 36/2.5 AL |
| 3,535,800 | 10/1970 | Stohr | 36/2.5 AL |
| 3,786,581 | 1/1974 | Mochizuki | 36/2.5 AL |

*Primary Examiner*—Patrick D. Lawson

[57] ABSTRACT

A ski boot molded to be relatively stiff in a lateral direction but independently flexible in the forward-backward direction, characterized by molded elastomeric hinges and corrugations.

10 Claims, 3 Drawing Figures

MOLDED HINGED AND CORRUGATED SKI BOOT

BACKGROUND

A ski boot performs better if it is relatively stiff latterally, but has some independent flexibility in a forward-backward direction. Numerous designs are known wherein two separately molded sections are joined by pinned hinges, usually with a common hinge axis that approximately corresponds to the skier's ankle joints. Means to constrain the forward-backward motion about the hinges may depend on constraining hardware or simply on the way the boot sections are molded so that one section presses into the other. Many other designs do not use hinges, but then additional flexibility in the forward-backward direction usually leads to additional flexibility in the latteral direction.

It is the object of this invention to make a ski boot that can be molded and ascembled with minimum expense and hardware, and still retain the advantages of a flexible hinged boot with latteral stiffness. It is a further object to make a boot that is easy to put on and take off, and that will fit a variety of foot shapes without specially shaped liners.

BRIEF DISCRIPTION OF THE DRAWINGS

DESCRIPTION OF THE INVENTION

Figure 2:
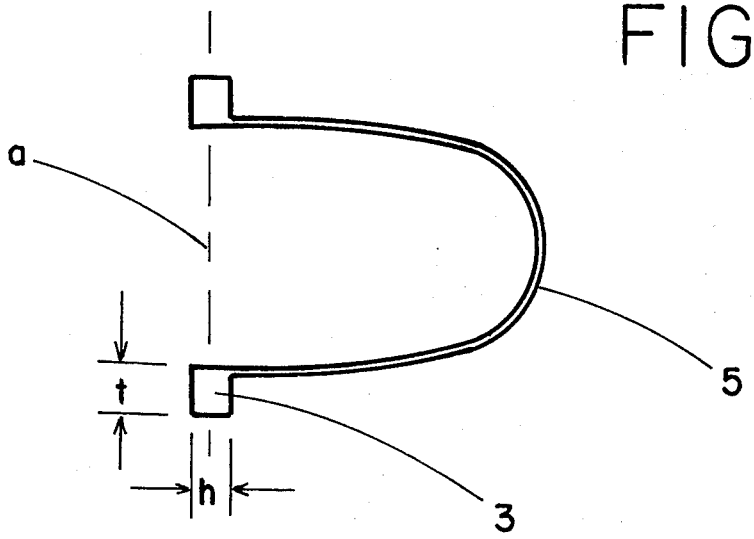
FIG. 2 shows a hinge portion of the ski boot of FIG. 1.

In common with many ski boots the subject boot has a foot-holding section and a leg-holding section. As shown in FIG. I, these respective sections, 1 and 2, are uniquely connected by integrally molded elastomeric hinges, 3. These hinges are molded to make them flex along a common axis that approximately coincides with the axis of the skier's ankle joints. As shown in FIG. 2, a view of a cross section taken nearly horizontally thru the boot at hinge hight, these hinges are relatively thick (see dimension $t$) in line with this axis ($a$), preferably as thick or thicker than they are in the horizontal forward-backward dimension ($h$). This said foreward-backward dimension ($h$) does not include the thinner molded corrugated section 5 shown extending around the front of the boot from hinge to hinge. The thickness ($t$) of the hinges in line with the axis ($a$) provides the boot with the desired latteral stiffness. The desired forward-backward flexibility is dependent on the internal stiffness of the hinges and the stiffness contributed by the molded corrugations 5.

Figure 3:
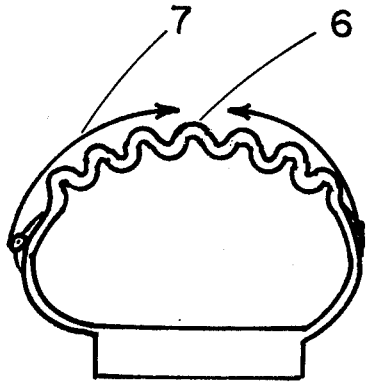
FIG. 3 shows a corrugated portion of the ski boot of FIG. 1.

In common with most ski boots, means are provided to hold the skier's foot, heel, and lower leg so they can not move loosely within the boot. However instead of a usual slit front, FIG. I shows how molded corrugations 6 can be provided to make the boot flexible enough to accommodate the width of a foot, and flexible enough to be drawn snugly around the foot by buckle 7. FIG. 3, a view of a section taken nearly vertically thru the foot-holding section, shows another view of the corrugations 6. The buckle 7 is symbolized by arrows in FIG. 3. It is preferred to make the corrugations 6 relatively stiff and to arrange for the buckle 7 to have the leverage and strength to tighten the front of the boot across the skier's foot. On the other hand, it is more economical to eliminate the need for this buckle 7 if the thickness, shape, and elasticity of corrugations 6 can be set so that the skier can force his foot into the boot and a satisfactory degree of snugness continues to hold the foot.

A preferred means for holding the skier's heel in position is the internal strap 8 with an extension passing through the shell of the boot to an external buckle 9.

All of the boot except the buckles, strap, and the rear flexible snow guard 10 can be molded in one piece, but there is an advantage to molding the heel-holding section 4 separately. It facilitates the installation and fastening of one end of strap 8. Moreover, grooves can be molded into section 1 and/or section 4 so that when section 4 is fitted into position in section 1 an internal passageway is properly located for the extension of strap 8 to reach the hole in the shell of the boot. This passageway functions as a guide for the extension of strap 8 and it tends to keep snow and water out of the boot. When section 4 is separately molded it also facilitates the molding of section 1, by making it easier to withdraw the mold from inside section 1.

An elastomeric polymer with good physical properties that do not change apreciably when cold is a preferred material of construction. For instance du Pont's "Adiprene" urethane will remain flexible and tough, and is well suited to make such ski boots. This polymer can be formulated to be relatively hard and stiff as compared to most rubber materials, but it still can be stretched or elongated several times its normal length when cold; therefore it can be considered flexible even though it seems relatively stiff.

Figure 1:
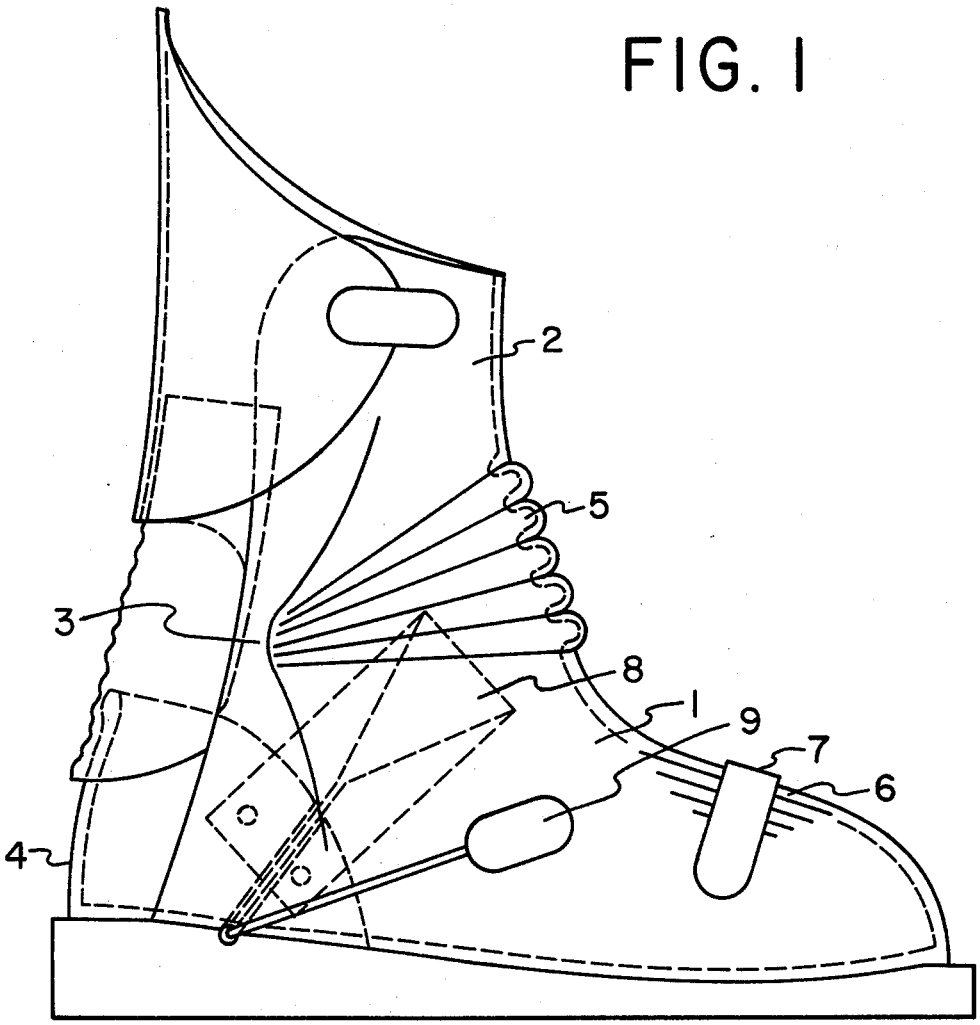
FIG. 1 is a side view of a ski boot showing the hinges and corrugations.

It will be apparent that for a given polymer formulation a variation in boot shell thickness or shape will affect the stress/strain characteristics or the performance of the boot. Thickness in the hinges contributes to latteral stiffness but has relatively little effect on the forward-backward stiffness. When the boot is flexed forward it is the molded corrugations 5 that are strained the most. These corrugations are shaped to accommodate this strain. As can be seen from FIG. 1, the molded corrugations 5 extend around the front of the boot from hinge to hinge, with the corrugations substantially focusing or pointing toward the axis of the hinges. When the skier leans back the corrugations 5 and all material in front of the hinge axis is stressed and strained in tension, and all material behind the axis is stressed and strained in compression.

What is claimed is:

1. A molded ski boot having substantial stiffness in the latteral direction and independent flexibility in the forward-backward direction, said boot having elements that include:

a. a foot-covering section, b. a leg-holding section, c. a sole, and d. elastomeric hinges integrally molded with and connecting the leg-holding section to the foot-covering section, said hinges being on each side of the boot and having a common horizontal axis that is approximately parallel to the axis of the skier's ankle joint which allows forward-backward motion of the skier's leg relative to his foot, said hinges being identifiable by their geometry wherein each hinge has a relatively great thickness as measured in the line of the axis, said thickness being at least two times the average thickness of other sections of the ski boot excluding the sole, and each hinge has a surface projecting forward of the axis and a surface projecting backward from the axis, and the average horizontal distance between these surfaces and through the axis is not more than three times the thickness of each hinge as measured along the axis.

2. A molded ski boot having substantial stiffness in the latteral direction and independent flexibility in the forward-backward direction, said boot having elements that include:

a. a foot-covering section, b. a leg-holding section, c. a sole, and d. elastomeric hinges integrally molded with and connecting the leg-holding section to the foot-covering section, said hinges being on each side of the boot and having a common horizontal axis that is approximately parallel to the axis of the skier's ankle joint which allows forward-backward motion of the skier's leg relative to his foot, said hinges being indentifiable by their geometry wherein each hinge has a relatively great thickness as measured in the line of the axis, said thickness being at least 2½ times the average thickness of other sections of the boot excluding the sole, and each hinge has a surface projecting forward of the axis and a surface projecting backward from the axis, and the average horizontal distance between these surfaces and through the axis is not more than 2½ times the thickness of each hinge as measured along the axis.

3. A molded ski boot having substantial stiffness in the latteral direction and independent flexability in the forward-backward direction, said boot having elements that include:

a. a foot-covering section, b. a leg-holding section, c. a sole, and d. elastomeric hinges integrally molded with and connecting the leg-holding section to the foot-holding section, said hinges being on each side of the boot and having a common horizontal axis that is approximately parallel to the axis of the skier's ankle joint, said hinges each having a relatively great thickness as measured in the line of the axis, said thickness being at least three times the average thickness of other sections of the boot excluding the sole, and each hinge has a surface projecting forward of the axis and a surface projecting backward from the axis, and the average horizontal distance between these surfaces and through the axis is approximately equal to or less than the thickness of each hinge as measured along the axis.

4. A molded ski boot as in claim 1 having an integrally molded corrugated flexible section also joining the leg-holding section to the foot-covering section and connected to the front surface of each hinge, with the molded lines of the corrugations extending from hinge to hinge, said flexible section being arranged to accommodate the compression strain and the tension strain that occurs when the skier leans forward or backward in the boot, and being arranged so there are no openings on the forward side of the boot through which water can penetrate.

5. A molded ski boot as in claim 4, integrally molded from an elastomeric material so as to prevent water from penetrating the front surface of the boot, wherein that part of the boot which covers the wide part of the skier's foot behind his toes is corrugated with the lines of the corrugations running approximately parallel to the length of the boot, and one or more conventional-type adjustable buckles are provided to tighten and clamp the two sides of the boot against the skier's foot.

6. A molded ski boot as in claim 4, integrally molded from an elastomeric material so as to prevent water from penetrating the front surface of the boot, wherein that part of the boot which covers the wide part of the skier's foot behind his toes is corrugated with the lines of the corrugations running from front to back, and the said corrugations are formed to be flexible enough to allow the skier to force his foot into the boot with some expansion of the corrugations, after which the corrugations maintain an elastic pressure on the sides of the skier's foot.

7. A molded ski boot integrally molded from an elastomeric material so as to prevent water from penetrating the front surface of the boot, wherein that part of the boot which covers the wide part of the skier's foot behind his toes is corrugated with the lines of the corrugations running approximately from front to back, and one or more conventional-type adjustable buckles are provided to compress the corrugations and tighten the two sides of the boot against the skier's foot.

8. A molded ski boot integrally molded from an elastomeric material so as to prevent water from penetrating the front surface of the boot, wherein that part of the boot which covers the wide part of the skier's foot behind his toes is corrugated with the lines of the corrugations running essentially from front to back, and the said corrugations are formed to be flexible enough to allow the skier to force his foot into the boot with some elastic expansion of the corrugations, after which the corrugations maintain an elastic pressure on the sides of the skier's foot.

9. A ski boot as in claim 4, integrally molded from an elastomeric material so as to prevent water from penetrating the front of the boot, wherein a separately molded heel-holding section is shaped to fit into the back of the foot-covering section, and with the assembly of these sections to make a ski boot there is provided an internal strap capable of holding the skier's heel down and back in the heel-holding section, and a molded vertical passageway between the said sections is formed by their assembly, said passageway being shaped to accommodate the means by which the internal strap can be tightened from the outside of the boot, and being shaped to prevent water from passing directly into the boot at the point where a strap-tensioning member penetrates the boot.

10. A molded ski boot having substantial stiffness in the latteral direction and independent flexibility in the forward-backward direction, said boot having elements that include:

a. a foot-covering section, b. a leg-holding section, c. a sole, d. elastomeric hinges integrally molded with and connecting the leg-holding section to the foot-covering section, said hinges being on each side of the boot and having a common horizontal axis that is approximately parallel to the axis of the skier's ankle joint which allows forward-backward motion of the skier's leg relative to his foot, said hinges each having a relatively great thickness as measured in the line of the axis, said thickness being at least 2½ times the average thickness of other sections of the boot excluding the sole, and each hinge has a surface projecting forward of the axis and a surface projecting backward from the axis, and the average horizontal distance between these surfaces and through the axis is approximately equal to or less than the thickness of each hinge as measured along the axis, e. an integrally molded corrugated flexible section, which extends between the leg-holding section and the foot-covering section in front of the hinges, with the molded lines of the corrugations extending from hinge to hinge, said flexible section being arranged to accomodate the compression strain and the tension strain that occurs when the skier leans forward or backward in the boot, and being arranged so there are no openings on the forward side of the boot through which water can penetrate, f. Molded corrugations in that part of the boot which covers the wide part of the skier's foot behind his toes, said corrugations being substantially in line with the length of the boot and being arranged so that an attached adjustable clamping buckle can compress the corrugations and tighten this part of the boot around the skier's foot, g. a separately molded heel-holding section, shaped to fit into the back of the foot-covering section, wherein with the assembly of the ski boot there is provided an internal strap capable of holding the skier's heel down and back in the heel-holding section, and a vertical passageway is formed between the said sections when they are assembled, said passageway being shaped to accommodate the means by which the internal strap can be tightened from the outside of the boot, and being shaped to prevent water from passing directly into the boot at the point where a strap-tensioning member penetrates the boot, and h. a separately made flexible section arranged to be attached to the back of the boot to keep snow out of the opening through which the skier inserts his foot into the boot.

* * * * *